US005482115A

United States Patent [19]

Ikeya et al.

[11] Patent Number: 5,482,115

[45] Date of Patent: Jan. 9, 1996

[54] HEAT EXCHANGER AND PLATE FIN THEREFOR

[75] Inventors: Jitsuo Ikeya; Yoshiro Nakamura; Hirotoshi Fukuoka, all of Shizuoka, Japan

[73] Assignee: Kabushiki Kaisha Toshiba, Kawasaki, Japan

[21] Appl. No.: 394,297

[22] Filed: Feb. 24, 1995

[30] Foreign Application Priority Data

Feb. 25, 1994 [JP] Japan ..... 6-028308

[51] Int. Cl.[6] ..... F28D 1/04; F28F 1/32

[52] U.S. Cl. ..... 165/151; 29/890.03; 29/890.047; 165/76

[58] Field of Search ..... 165/76, 151, 182; 29/890.03, 890.047

[56] References Cited

U.S. PATENT DOCUMENTS

| | | | |
|---|---|---|---|
| 4,169,502 | 10/1979 | Kluck | 165/151 |
| 4,434,843 | 3/1984 | Alford . | |
| 5,174,366 | 12/1992 | Nagakura et al. | 165/77 |
| 5,267,610 | 12/1993 | Culbert | 165/151 |
| 5,318,112 | 6/1994 | Gopin | 165/151 |

FOREIGN PATENT DOCUMENTS

| | | | |
|---|---|---|---|
| 1209776 | 3/1960 | France | 165/151 |
| 3156221 | 7/1991 | Japan . | |
| 4-20793 | 1/1992 | Japan | 165/151 |
| 440024 | 12/1935 | United Kingdom | 165/151 |

*Primary Examiner*—Allen J. Flanigan
*Attorney, Agent, or Firm*—Cushman, Darby & Cushman

[57] ABSTRACT

A bent finned tube heat exchanger to transfer heat between a fluid passing through the tubes and a fluid passing around the heat exchanger, and a plate fin therefor. The plate fin has a zigzag shape defining a plurality of sharp parts and pointing alternately in opposite directions, a plurality of weakened portions, each provided between adjacent sharp parts and holes in the sharp parts aligned in two lines in the longitudinal direction of the plate fin. The heat exchanger is constructed with a plurality of the plate fins and tubes passing through the holes of the plate fins. The sharp parts are separated from each other, along the weakened portions, during bending so that the lengths of the tubes in the two lines is equalized when the heat exchanger is bent.

8 Claims, 8 Drawing Sheets

HEAT EXCHANGER AND PLATE FIN THEREFOR

BACKGROUND OF THE INVENTION

1. Field of the Invention

The present invention relates to a plate fin and tube heat exchanger used in air conditioning, refrigeration and other applications.

2. Description of the Related Art

Plate fin and tube heat exchangers are used in a wide variety of applications in which it is desired to exchange heat between two fluids, a refrigerant flowing in the heat exchanger tubes and, typically, air flowing around the heat exchanger plate fins and tube exteriors.

In such a heat exchanger, a plurality of plate fins having holes are arranged parallel to each other. Heat exchanger tubes pass through the holes in the plate fins. The heat exchanger tubes are expanded in the radial direction to tightly connect them with the plate fins. A tight connection between the tubes and the plate fins increases the heat transfer performance. A conventional heat exchanger has heat exchanger tubes arranged in one row in the longitudinal direction of the plate fins. In the conventional heat exchanger, as the number of heat exchanger tubes increases, more heat is transferred between a fluid passing through the tubes and the fins. However, the air volume passing through the heat exchanger decreases because the gaps or distances between the adjacent heat exchanger tubes become narrow. As a result, the total heat transfer performance is not greatly improved.

In order to improve the heat transfer performance, a heat exchanger having a plurality of staggered rows of tubes through the plate fins was developed as described in U.S. Pat. No. 4,434,843. The heat exchanger uses a large number of tubes provided in a zigzag or staggered configuration along the plate fins. The gaps between adjacent tubes are sufficient to ensure a large air volume passing therethrough so that the heat transfer performance is improved.

There is also known a bent type heat exchanger which is partially bent in the longitudinal direction of the heat exchanger tubes. The bent type heat exchanger, which is formed with a corner section and straight section, reduces the size of the heat exchanger unit. However, it is not simple to apply the above described staggered heat exchanger in the bent type heat exchanger, because the length of the inner row of bent tubes must be shorter than that of the outer row of bent tubes.

SUMMARY OF THE INVENTION

It is an object of the invention to provide an improved plate fin suitable for a plate fin and tube heat exchanger having a corner section.

It is another object of the invention to provide an improved plate fin and tube heat exchanger having a corner section.

It is further object of the invention to provide an improved method for manufacturing a plate fin and tube heat exchanger having a corner section.

To achieve the above objects, there is provided an improved plate fin for a plate fin and tube heat exchanger which has a plurality of spaced fins having holes and tubes passing through the holes in the plate fins. The heat exchanger has a corner section which is formed by bending the tubes in the longitudinal direction of the tubes. The plate fin is formed with a zigzag shape, a plurality of sharp parts turning to one side and the other side, and a plurality of weakened portions easily broken apart. Each of the broken portions is provided between the adjacent sharp parts. The holes stand in two lines in the longitudinal direction of the fin.

There is further provided a method for manufacturing a heat exchanger. A plurality of longitudinal plate fins are provided, formed with a zigzag shape, a plurality of sharp parts turning to one side and the other side, and weakened portions each provided between adjacent sharp parts. Holes are also provided in the sharp parts. The fins are stacked with a predetermined space. A plurality of tubes are also provided with each tube inserted into one of the holes in each plate fin, respectively, so as to form two rows of tubes in the longitudinal direction of the fins. The tubes are then expanded to engage the fins. Also, a predetermined portion of the tubes and fins are bent to separate the sharp parts from each other so that the lengths of the tubes in the first and second rows are equalized.

BRIEF DESCRIPTION OF THE DRAWINGS

In the accompanying drawings:

FIG. 2(*b*) is an enlarged cross-sectional view of the plate fin taken along the 2(*b*)—2(*b*) line in FIG. 2(*a*);

FIG. 7(*b*) is a cross-sectional view of the heat exchanger and the bending machine taken along the 7(*b*)—7(*b*) line of FIG. 7(*a*);

DETAILED DESCRIPTION OF PREFERRED EMBODIMENT

An embodiment of the present invention will now be explained with reference to the accompanying drawings.

Figure 1:
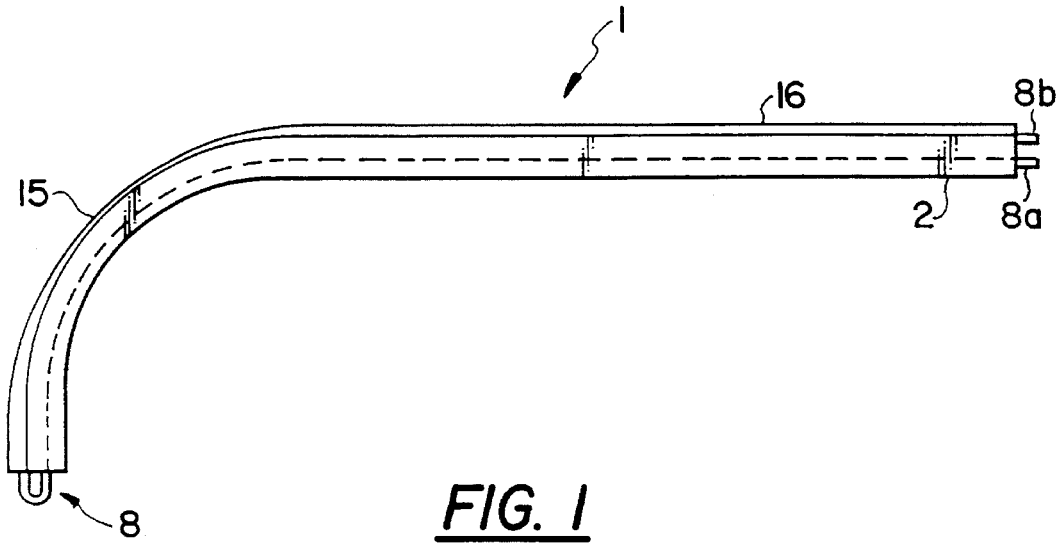
FIG. 1 is a schematic top view of a heat exchanger, which has a bent section formed on one end portion thereof.

FIG. 1 is top view of a plate fin and tube heat exchanger 1 as one embodiment of the invention. Heat exchanger 1 contains a plurality of spaced fins 2 and a plurality of tubes 8 traversely arranged with respect to fins 2. Each fin 2 is formed with a longitudinal plate, and has a plurality of holes (not shown in FIG. 1) provided thereon for passing tubes 8*a*, 8*b*. The holes are staggered in two rows in the longitudinal direction of fin 2. The tubes, a first row of tubes 8*a* and a second row of tubes 8*b*, pass through the holes so that tubes 8*a*, 8*b* stand in two rows and are staggered. Heat exchanger 1 has a corner section 15 provided on one end thereof and a straight section 16. Corner section 15 is formed into a circular arc surface, smoothly connecting to the surface of straight section 16.

Figure 2A:
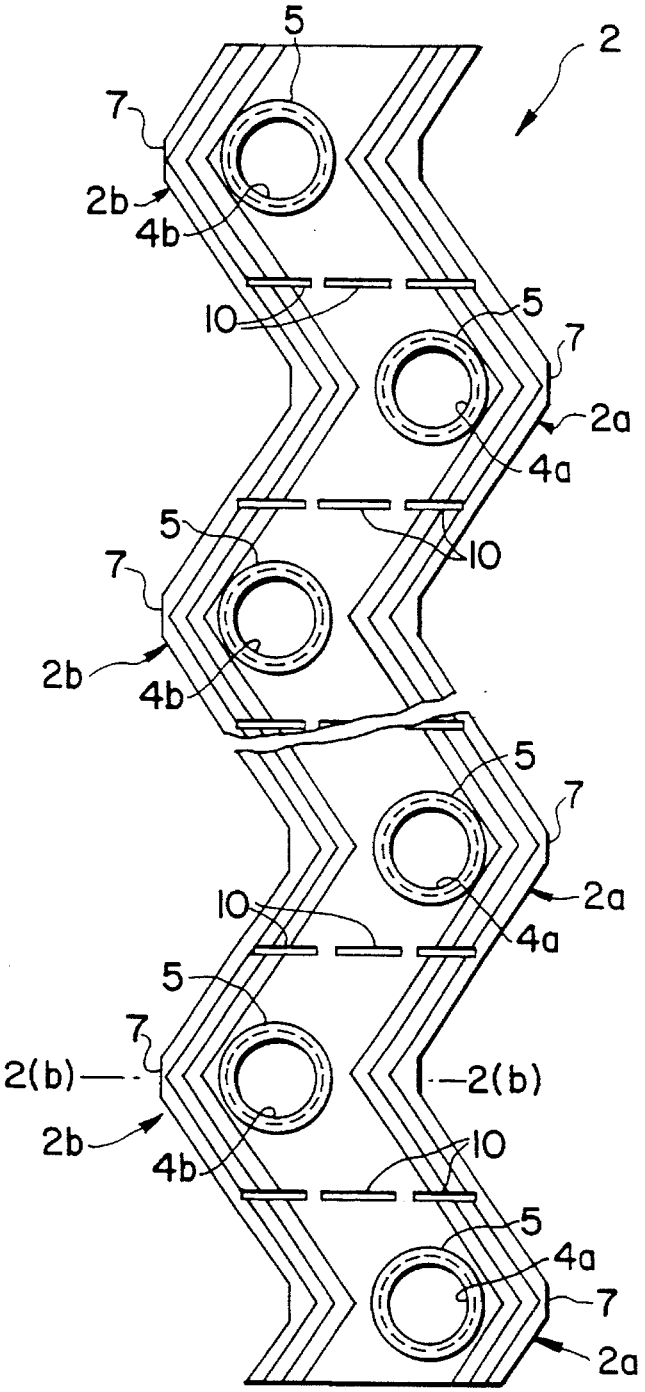
FIG. 2(*a*) is a plan view of a plate fin used for the heat exchanger shown in FIG. 1.
Figure 2B:
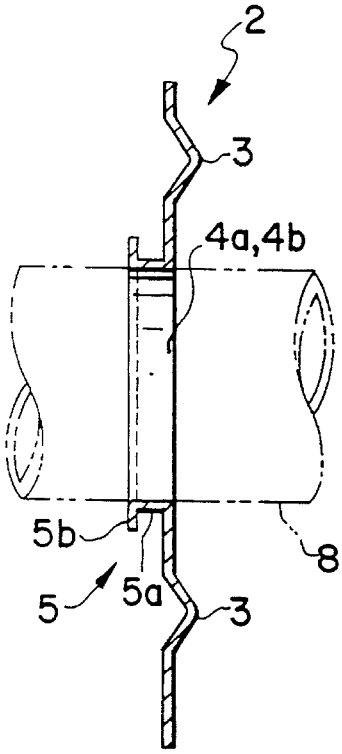

Referring now to FIGS. 2(*a*) and 2(*b*), fin 2 is a longitudinal plate, however, in FIG.2(*a*). The middle portion of fin 2 is broken away since the broken away portion has a pattern similar to the pattern shown. Fin 2 is formed with a zigzag shape which is produced by punching, drawing or embossing thick fin sheet metal made of aluminum or an aluminum alloy. Fin 2 has a plurality of first sharp parts 2*a* projecting to one side and a plurality of second sharp parts 2*b* projecting the other side. Holes 4*a*, 4*b* are provided approximately in the center of each of sharp parts 2*a*, 2*b*, respectively, for receiving tubes 8*a*, 8*b* therein. As shown in FIG. 2(*b*), fins 2 have fin collars 5 provided around the edges of holes 4*a*, 4*b* for supporting the outer surfaces of tubes 8*a*, 8*b*. Collar 5 has a sleeve 5*a* extended out from the fin plate and a flange 5*b* located at the top of sleeve 5*a*. Projections 3 are provided in the opposite direction of fin collar 5 for reinforcing fin 2.

A weakened portion 10 is provided between each adjacent pair of first and second sharp parts 2*a*, 2*b*. Each weakened portion 10 has perforations along the width direction of fin 2, so that fin 2 is easily torn in two pieces when first and second sharp parts 2*a*, 2*b* are forcibly displaced in the opposite directions along the perforations. Alternatively, weakened portions 10 may be thinner metal portions as compared to the remainder of fin 2. Cut away portions 7 are provided on the top ends of sharp parts 2*a*, 2*b*, for safety in manufacturing heat exchanger 1.

Figure 3:
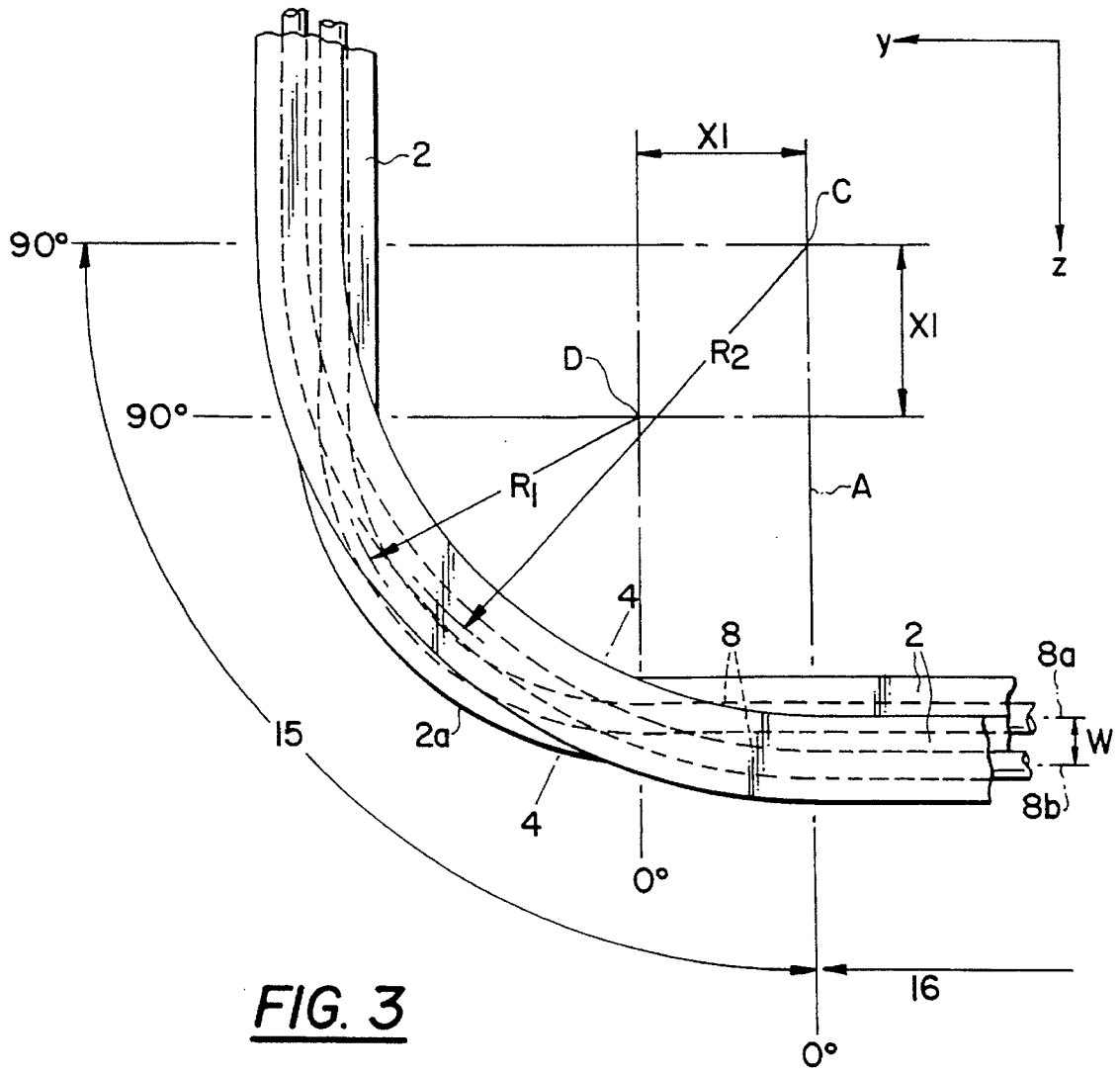
FIG. 3 is an enlarged schematic top view of the corner section of the heat exchanger.
Figure 4:
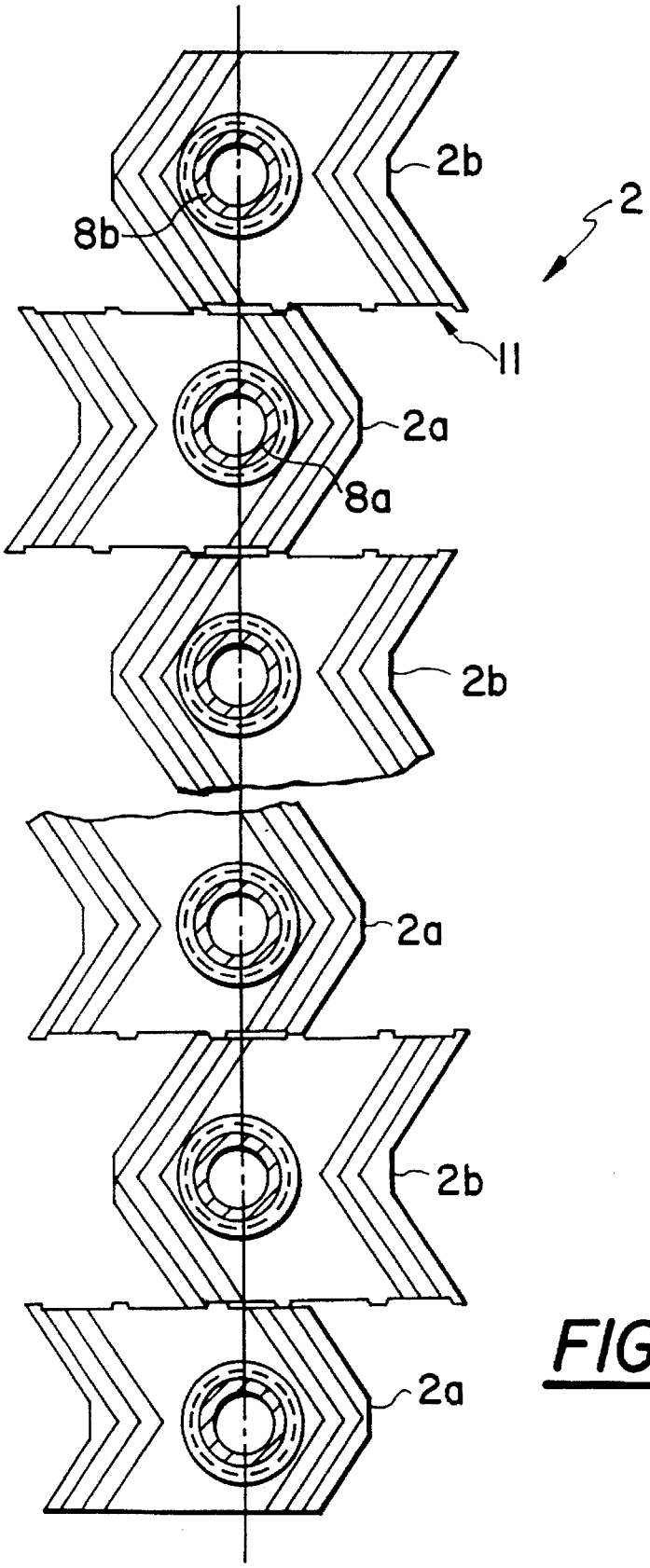
FIG. 4 is a cross-sectional view of the corner section of the heat exchanger taken along the 4—4 line of FIG. 3.

Referring now to FIG. 3 and FIG.4 the manner in which corner section 15 of heat exchanger 1 is formed will be explained.

When tubes 8*a*, 8*b* are bent, fins 2 split along weakened portions 10. Therefore, sharp parts 2*a*, 2*b* are displaced along weakened portions 10 so that first and second row tubes 8*a*, 8*b* draw different loci to equalize the length of tubes 8*a*, 8*b*. On the 4—4 line of FIG. 3, first row tubes 8*a* and second row tubes 8*b* stand in one line as shown as in FIG. 4. Heat exchanger 1 is obtained by bending one end of the flat rectangular heat exchanger in FIGS. 6(*a*)–6(*c*). At corner section 15, first row tubes 8*a* are formed with a curved portion with a radius R1 between two straight portions. Second row tubes 8*b* are formed with a curved portion with radius R2. the center of the curved portion of second row tubes 8*b* is indicated by C while the center of the curved portion of first row tubes 8*a* is indicated by D. As shown FIG. 3, radius R2 is longer than radius R1. Center D is displaced from center C by a distance X1 in direction y and is also displaced the same distance from center C in direction z in FIG. 3. Thus the straight portions on opposite ends of first row tubes 8*a* have a length X1 longer than the corresponding straight portions of second row tubes 8*b*.

Over corner section 15, first row tubes 8*a* and second row tubes 8*b* are set to be the same length. Therefore, bent type heat exchanger 1 can be formed from the rectangular shaped heat exchanger shown in FIGS. 6(*a*)–6(*c*).

The condition for equalizing the length of both tubes 8*a*, 8*b* is described hereinbelow. The length La of first row tubes 8*a* at corner section 15 is given by the following formula (1).

$$La = \frac{\pi \times R1}{2} + 2 \times X1 \tag{1}$$

The length Lb of second row tubes 8*b* at corner section 15 is given by the following formula (2).

$$Lb = \frac{\pi \times R2}{2} \tag{2}$$

To equalize the lengths of tubes 8*a* and 8*b*, La must equal Lb. As a result, the following formula (3) is derived.

$$\frac{\pi \times R1}{2} + 2 \times X1 = \frac{\pi \times R2}{2} \tag{3}$$

On the line A in FIG. 3, the following formula (4) results:

$$R2 = X1 + R1 + W \tag{4}$$

Where W is the distance between the centers of first and second row tubes 8*a*, 8*b* at straight section 16 in the direction z.

From formulas (3) and (4), R2 and R1 is eliminated. Then the following formula (5) derived.

$$(4-\pi) \times X1 = \pi \times W \tag{5}$$

In designing a heat exchanger, at first, the distance W is determined in order to obtain sufficient heat transfer between a fluid passing through the tubes of the heat exchanger and a fluid passing around the tubes and fins. Then, the radius R1 is determined as approximately the minimum radius at which first row tubes 8*a* can be bent at corner section 15 without damage. As radius R1 becomes shorter, the heat exchanger becomes smaller. After determining the interval W and the radius R1, the length X1 is determined by the formula (5), then the radius R2 is determined by the formula (3) or (4).

In one embodiment of the heat exchanger, the distance W and R1 are determined as 13 mm and 80 mm, respectively. The length X1 is calculated to be about 48 mm and the radius R2 is calculated to be about 141 mm.

Figure 5:
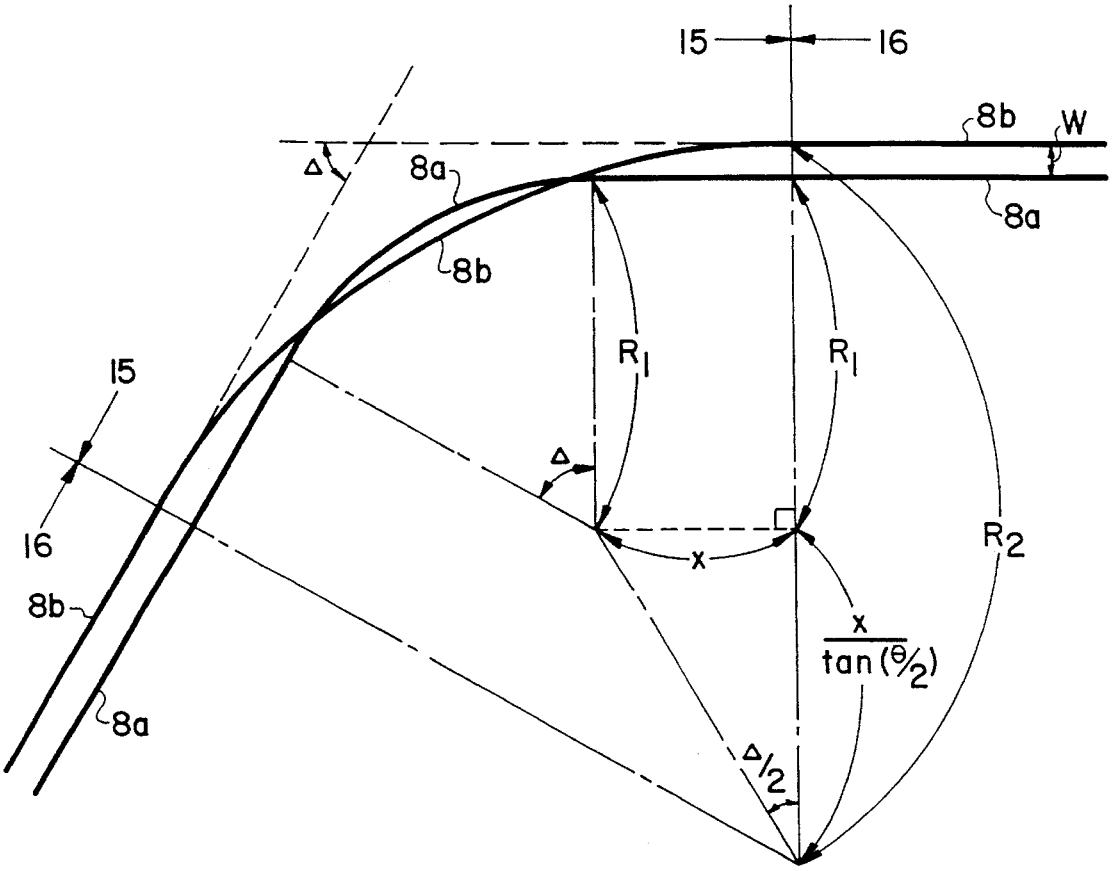
FIG. 5 is schematic top view of a loci of tubes located at the corner section of the heat exchanger.

The above formulas apply when the center angle of bending is 90 degrees. Using the variables in FIG. 5, more general formulas at the center angle Δ are described as follows:

$$La = 2\pi R1 \times \left( \frac{\Delta}{360} \right) + 2X1 \tag{6}$$

$$Lb = 2\pi R2 \times \left( \frac{\Delta}{360} \right) \tag{7}$$

$$\pi R1 \times \Delta + 360 \times X1 = \pi R2 \times \Delta \tag{8}$$

$$R2 = \frac{X1}{\tan(\Delta/2)} + R1 + W \tag{9}$$

$$X1 = \frac{\tan(\Delta/2)\pi\Delta}{360\tan(\Delta/2) - \pi\Delta} \times W \tag{10}$$

Accordingly, a preferable configuration at the desired center angle can be designed on the basis of the above general formulas (9) and (10).

Figure 6A:
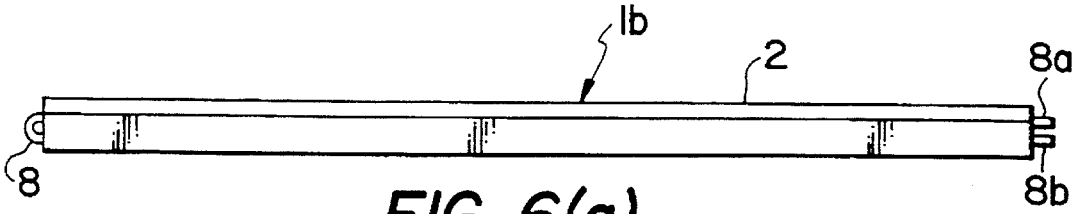
FIG. 6(*a*) to FIG. 6(*c*) are schematic top, front and side views, respectively, of a plate fin and tube heat exchanger, before the heat exchanger is bent.
Figure 6B:
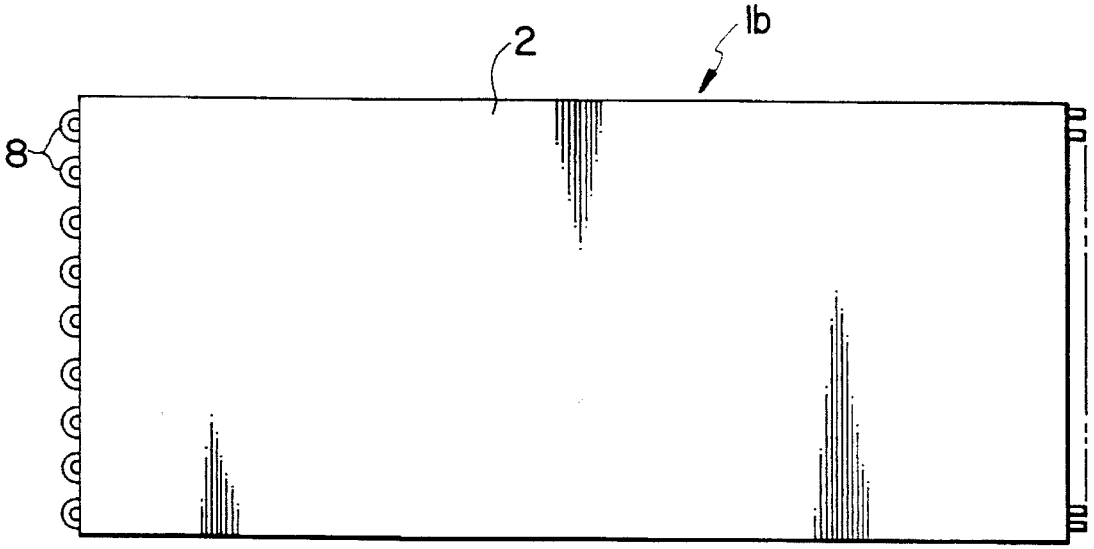
Figure 6C:
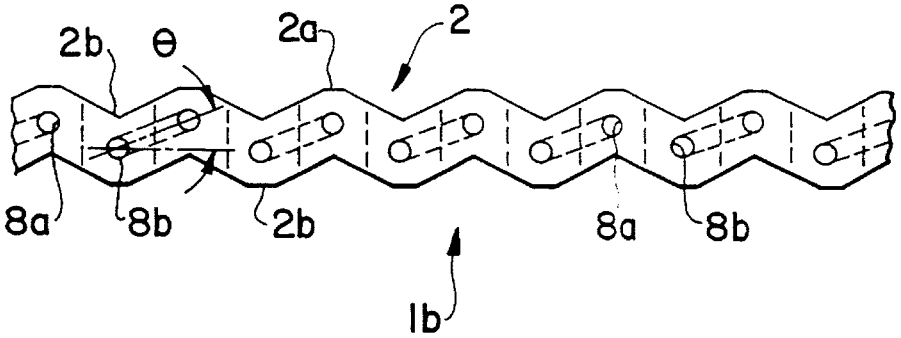

Referring now to FIG. 6(*a*) to FIG. 7(*b*), the method for manufacturing the heat exchanger will be explained, where like reference characters designate identical or corresponding elements of the above mentioned heat exchanger.

First, a plurality of fins 2 are stacked with a narrow space therebetween. The spaces between adjacent fins 2 are kept by collars 5. Stacked together fins 2 form a rectangular stack. Tubes 8*a*, 8*b* are inserted into collars 5 and holes 4*a*, 4*b* , respectively, so that tubes 8*a*, 8*b* are arranged in two rows. First row tubes 8*a* and second row tubes 8*b* are perpendicular to the planar surface of fins 2. Tubes 8*a*, 8*b* have a hairpin shape, having two legs inserted into holes 4*a*, 4*b* at the same time. As shown in FIG. 6(*c*), tubes 8*a*, 8*b* are inclined at an angle of θ degrees to the longitudinal direction of the fin plates. After tubes 8*a*, 8*b* are inserted in holes 4*a*, 4*b* , tubes 8*a*, 8*b* are expanded to the radial direction to insure a tight mechanical fit between tubes 8*a*, 8*b* and collars 5 of fins 2.

If needed, the ends of tubes 8*a*, 8*b* can be connected to form one or more closed fluid flow paths through the heat exchanger.

As shown in FIG. 6(*c*), heat exchanger 1*b* has waved front and rear surfaces. With the same planar front area, heat transfer performance of heat exchanger 1*b* is approximately 1.1 to 1.2 times larger than a conventional heat exchanger having flat front and rear surfaces, while the number of tubes 8 used in the heat exchanger 1*b* is more than approximately 1.2 times the conventional heat exchanger. Distances between adjacent tubes 8*a*, 8*b* are kept within a range so that the volume of fluid passing through the heat exchanger is not substantially decreased.

Figure 7A:
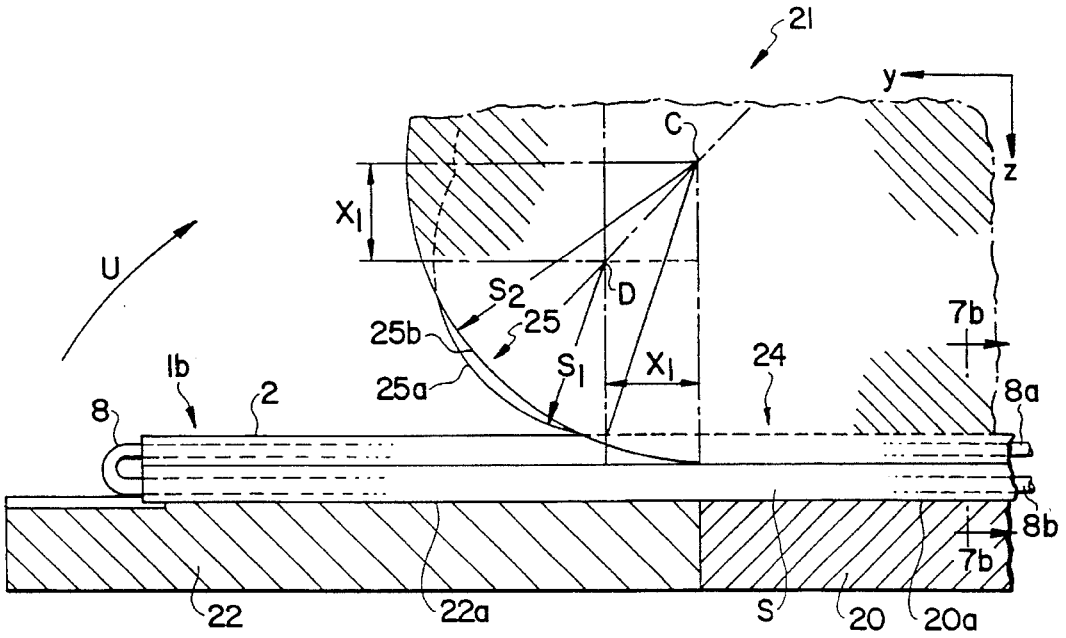
FIG. 7(*a*) is a schematic plan view of the heat exchanger and an improved bending machine for bending the heat exchanger.
Figure 7B:
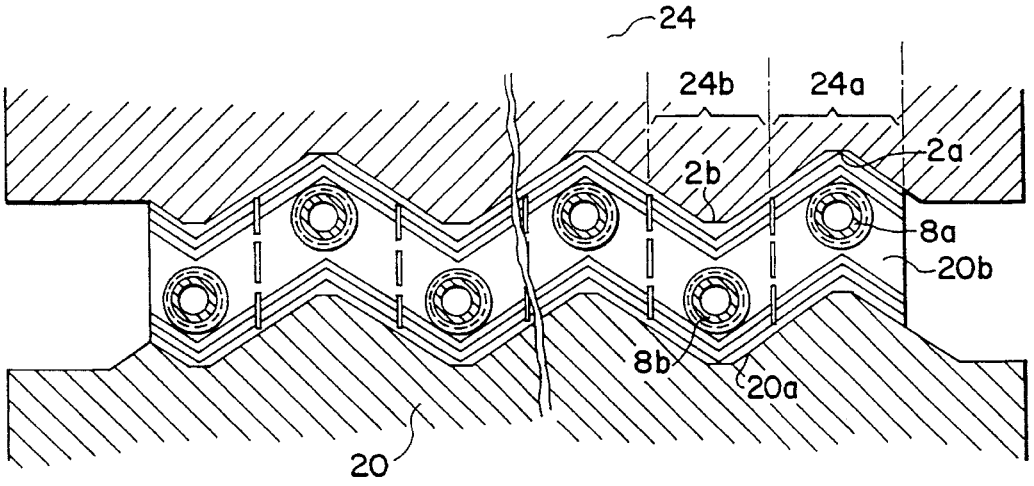

Bending machine 50 is shown in FIGS. 7(*a*) and 7(2). Bending machine 50 bends heat exchanger 1*b* to form heat exchanger 1. The bending machine has a lower fixing jig 20 and an upper jig 21 for fixing one end portion of heat exchanger 1*b* therebetween, and a lower bending jig 22 for bending the other end portion of heat exchanger 1*b*. Lower fixing jig 20 has a fixing plate 20*a* having Corrugated surfaces to fit with one of the surfaces of heat exchanger 1*b*. Lower bending jig 22 has a bending plate 22*a* formed with corrugated surfaces to fit with the same surface of the heat exchanger 1*b*. Upper fixing jig 21 has a fixing side 24 formed with corrugated surface for the same purpose as mentioned above.

As can be observed in FIG. 7(*b*), fixing side 24 has a plurality of concave portions 24*a* and convex portions 24*b*. Lower fixing jig 20 has corresponding portions. Each concave portion 24*a* fits with a sharp part 2*a* , while each convex portion 24*b* fits with a sharp part 2*b*. Concave portions 24*a* and convex portions 24*b* are alternately repeated.

Upper jig 21 has a curved side 25, connected to fixing side 24. Curved side 25 has a large cylindrical section 25*b* and a small cylindrical section 25*a*. Lower bending jig 22 has the same concave portions which fit with sharp parts 2*a* and convex portions which fit with sharp parts 2*b*. When lower bending 22 is moved to follow the surface of curved side 25, heat exchanger 1*b* is bent and each portion of lower bending jig 22 separately moves in the direction as indicated by arrow U in the FIG. 7(*a*).

The center of large cylindrical section 25*b* is indicated with C, while the center of small cylindrical section 25*a* is indicated with D in FIG. 7(*a*). The radii of cylindrical sections 25*b* , 25*a* are S1 and S2, respectively. The center D is displaced both in the direction y and z from the center C by a length X1. Each section 25*a*, 25*b* is formed over a curve of 90 degrees to bend straight heat exchanger 1*b* at a right angle. The angle at which heat exchanger 1*b* is bent is determined by the angle subtended by cylindrical sections 25*a*, 25*b* at their centers. Thus, the angle subtended by cylindrical sections 25*a*, 25*b* is selected to match the desired angle at which the heat exchanger is bent.

In designing curved side 25, the length X1 is same as X1 in equation (10). The radius S1 is calculated as the radius R1 in the equation (9) minus a distance between center line 9*b* of tube 8*b* and side end of the fin, while the radius S2 is calculate as the radius R2 minus the distance between center line 9*a* of tube 8*a* and side end of the fin.

When the lower bending jig 22 moves, straight heat exchanger 1*b* is moved in the direction as indicated by the arrow U shown in 7(*a*) and wound around curved side 25 of upper jig 21. As a result, first row tubes 8*a* and second row tubes 8*b* are bent by the small and large cylindrical sections 25*a*, 25*b*, respectively. As bending starts, tubes 8*a* keep their position in convex portions 4*a*. At the same time they are moved upwardly by force applied to the sharp parts 2*a*. As a result, fins 2 are separated along weakened portions 10. Sharp parts 2*a*, 2*b* are thus separated from each other and tubes 8*a*, 8*b* are arranged in the orientation shown in FIG. 4.

As fins 2 are torn, the tearing force concentrates between sharp parts 2*a*, 2*b*. Accordingly, as tubes 8*a*, 8*b* are bent, fins 2 maintain their shape. Specifically, fins 2 are separated into portions, but sharp parts 2*a*, 2*b* maintain their shape. After sharp parts 2*a*, 2*b* are separated, it is easy to bend tubes 8*a*, 8*b* along cylindrical section 25*a*, 25*b*, respectively.

Figure 8:
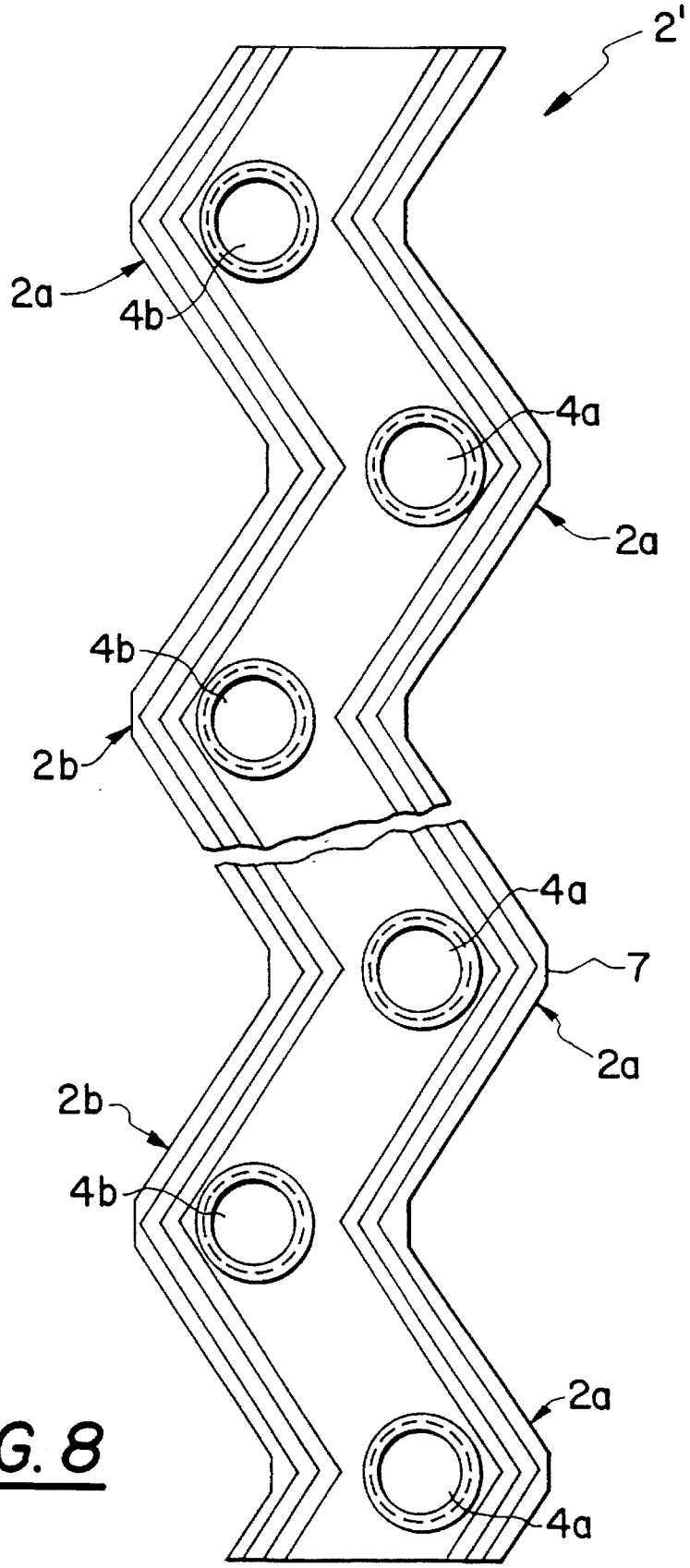
FIG. 8 is a plan view of a plate fin partially used the heat exchanger according to the invention.

FIG. 8 shows another plate fin 2'. The fin 2' may be used in straight section 16 of the heat exchanger in FIG. 1. Fin 2' has the same configuration and dimensions as fin 2 used in corner section 15 in FIG. 1, except fin 2' does not have the weakened portions. In straight section 16, sharp parts 2*a*, 2*b*, do not need to separate, so the fins can be used in straight section 16.

Figure 9:
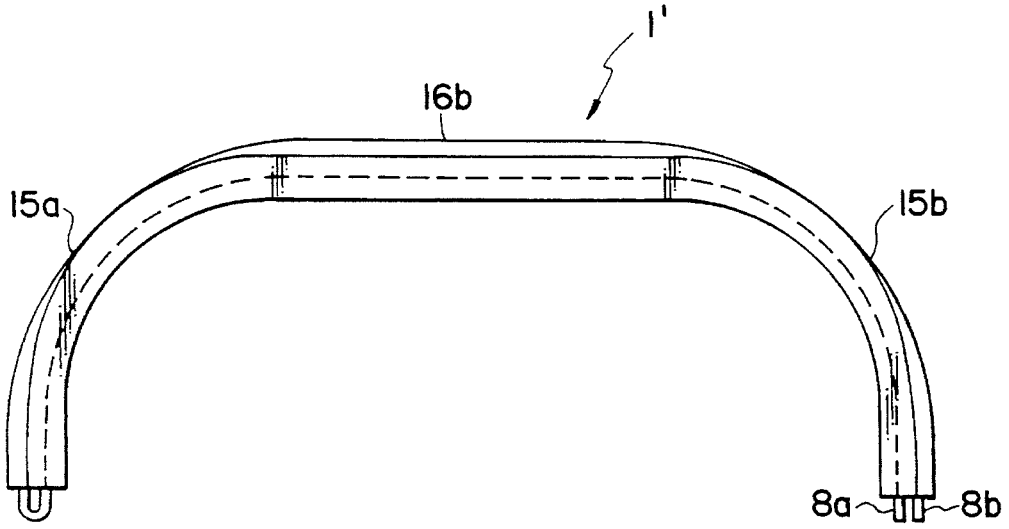
FIG. 9 is a schematic top view of a modified heat exchanger of the heat exchanger shown in FIG. 1, which has bent sections formed on both ends thereof.

FIG. 9 shows another embodiment of the heat exchanger according to the invention. Heat exchanger 1' has two corner sections 15*a*, 15*b* located at opposite ends of heat exchanger 1' and one straight section 16*b* between corner sections 15*a*, 15*b*. Heat exchanger 1' has fins 2 having holes staggered in two rows and tubes 8 in two rows as does the heat exchanger shown in FIG. 1. In each corner section 15*a*, 15*b*, the lengths of tubes 8*a'*, 8*b'* in each row are the same.

Many changes and modifications in the above described embodiments can be carried out without departing from the scope of the general inventive concept as defined by the appended claims and their equivalents.

What is claimed is:

1. A plate fin having a zigzag shape defining a plurality of sharp parts pointing alternately in opposite directions, the plate fin having a plurality of weakened portions each provided between adjacent sharp parts and holes in the sharp parts aligned in two lines in the longitudinal direction of the plate fin.

2. A plate fin according to claim 1, wherein each of the weakened portions includes a plurality of perforations provided across the width of the fin.

3. A bent heat exchanger comprising;

a plurality of plate fins, each fin having a zigzag shape defining a plurality of sharp parts pointing alternately in opposite directions, a plurality of weakened portions each provided between adjacent sharp parts and holes in the sharp parts aligned in two lines in the longitudinal direction of the plate fin; and a plurality of tubes, each passing through one of the holes of each of the plate fins, respectively, so as to form two rows of tubes in the longitudinal direction of the plate fins;

said tubes being bent so that a first row of tubes and a second row of tubes at a corner section are the same length, and said sharp parts are separated from each other at the weakened portions along the corner section.

4. A heat exchanger according to claim 3, wherein a loci of the first and second rows of tubes cross at two points over the corner section.

5. A heat exchanger according to claim 3, wherein each of the tubes of the first row of tubes and the second row of tubes are formed with different circular arcs in the corner section.

6. A method for manufacturing a heat exchanger comprising the steps of:

stacking a plurality of longitudinal plate fins with a predetermined space therebetween, each of the plate fins having a zigzag shape defining a plurality of sharp parts pointing alternatively in opposite directions, the plate fins including a plurality of weakened portions, each between adjacent sharp parts and holes provided at the sharp parts;

inserting each of a plurality of tubes into one of the holes of each of the plate fins, respectively, so as to form two rows of tubes in the longitudinal direction of the plate fins; and bending a predetermined portion of the tubes and fins, the bending causing adjacent sharp parts of each of the plate fins to separate from each other so that the lengths of the tubes of the first and second rows are equalized.

7. A method according to claim 6, wherein said bending step comprises the steps of:

fixing the tubes and fins;

arranging a curved tool adjacent to the predetermined portion of the tubes and the fins, the curved tool having a curve in the longitudinal direction of the tubes and having a configuration to fit one side of the fins in the direction of the width of the fin; and pushing the predetermined portion of the tubes and fins parallel to the curved tool with a pushing tool, the pushing tool having a straight form in the longitudinal direction of the tubes and having a figure to fit the other side of the fins to form the fins and tubes into a curved configuration.

8. A method according to claim 6, further comprising the step of expanding the tubes to engage the fins.

* * * * *